US005148662A

United States Patent [19]

Yamaguchi

[11] Patent Number: 5,148,662

[45] Date of Patent: Sep. 22, 1992

[54] ROTARY RING FOR SPINNING

[75] Inventor: Hiroshi Yamaguchi, 1601-17, Higashigata, Kuwana-shi, Mie, Japan

[73] Assignees: Hiroshi Yamaguchi; Hiroshi Kimura, both of Japan

[21] Appl. No.: 531,898

[22] Filed: Jun. 1, 1990

[30] Foreign Application Priority Data

Jun. 2, 1989 [JP] Japan ..... 1-141664

[51] Int. Cl.[5] ..... D01H 1/02; D01H 7/56

[52] U.S. Cl. ..... 57/78; 57/124

[58] Field of Search ..... 57/119, 122, 124, 78

[56] References Cited

U.S. PATENT DOCUMENTS

| | | | |
|---|---|---|---|
| 4,028,873 | 6/1977 | Schulz et al. | 57/124 |
| 4,095,402 | 6/1978 | Yamaguchi | 57/124 |
| 4,238,920 | 12/1980 | Le Chatelier | 57/124 |
| 4,343,145 | 8/1982 | Barro | 57/124 |

FOREIGN PATENT DOCUMENTS

| | | | |
|---|---|---|---|
| 2649193 | 5/1977 | Fed. Rep. of Germany . | |
| 52-55731 | 5/1977 | Japan . | |
| 62-206036 | 9/1987 | Japan . | |
| 62-299522 | 12/1987 | Japan . | |
| 1-104840 | 4/1989 | Japan . | |
| 201529 | 8/1989 | Japan | 57/124 |

*Primary Examiner*—Joseph J. Hail, III

*Attorney, Agent, or Firm*—Stevens, Davis, Miller & Mosher

[57] ABSTRACT

A rotary ring for spinning including a holder having a lower end face, a ring-shaped rotary member supported rotatably by a bearing inside the holder, a braking shoe carried by a lower end of the rotary member and having an upper portion fixed to the lower end of the rotary member, the braking shoe having a lower portion for extending radially outwardly from the upper portion in a conical shape, the lower portion having an inner face and an outer face, the braking shoe being of a flexibility and shape such that when the rotary member is rotated, the lower portion of the braking shoe will extend radially outwardly to a greater degree due to centrifugal force so that the lower portion will be moved in a space beneath the lower end face of the holder and generally toward the lower end face, a substantially annularly shaped non-magnetic braking runner positioned to be in contact with the outer face of the lower portion of the braking shoe, the non-magnetic braking runner being mounted so as to be carried by the outer face of the braking shoe to frictionally contact the lower end face of the holder and to exert a braking force thereon.

23 Claims, 15 Drawing Sheets

ROTARY RING FOR SPINNING

BACKGROUND OF THE INVENTION

1. Field of the Invention

The present invention relates to a rotary ring for spinning. More particularly, the present invention relates to a rotary ring including a ring-shaped rotary member rotated by a torque caused by a sliding friction given thereto by a traveller running thereon, and equipped with an improved braking mechanism thereof.

2. Description of the Related Art

A rotary ring comprising a holder, a bearing, and a ring-shaped rotary member supported rotatably through the bearing by the holder and rotated by a torque caused by a sliding friction given thereto by a traveller rotating thereon is known from, for example, Japanese Unexamined Patent Publication (Kokoku) No. 54-15934. Generally, the above type rotary ring is called a negative rotary ring for spinning, because this rotary ring is not equipped with a positive means of driving the ring-shaped rotary member.

In the negative rotary ring, it is necessary to provide a means for preventing an overrun of the ring-shaped rotary member generated when a spinning frame with the negative rotary rings is stopped. As the overrun preventing mechanism of the negative rotary ring, a rotation controlling mechanism is provided for controlling a rotation of the ring-shaped rotary member by a resistance of a wing or a protrusion attached thereto in a fluid such as an air or a liquid, or a braking mechanism for preventing an inertial rotation of the ring-shaped rotary member by mechanically applying a grasping force to the ring-shaped rotary member by using, for example, a lever or the like, are known.

The known ring-shaped rotary member overrun preventing mechanism has several disadvantages. For example, the mechanism having a wing capable of applying a resistance in air has a disadvantage in that, when a spindle and the corresponding ring-shaped rotary member are rotated at a high speed, and thus the inertial rotation becomes large, it is impossible to prevent an overrun of the ring-shaped rotary member. Although the mechanism disclosed in Japanese Unexamined Patent Publication No. 62-263331, in which a ring-shaped rotary member having a wing or a protrusion on a lower side thereof is used, can prevent the overrun of the ring-shaped rotary member by raising an oil bath when a spinning frame is stopped, to apply a braking force due to a resistance of the oil to the ring-shaped rotary member, this mechanism can apply only a simultaneous braking force on all of the ring-shaped rotary members in the spinning frame, and cannot apply the braking force for each ring-like rotary member individually. The mechanism disclosed in Japanese Unexamined Patent Publication No. 62-206036, in which a ring shaped rotary member having a lower end protruded from an under side of a ring rail is used, can prevent the overrun of the ring-shaped rotary member by directly applying a grasping force through a lever or the like to the ring-like rotary member, but has the same disadvantage as that of the mechanism disclosed in the Japanese Unexamined Patent Publication No. 62-26331. Namely this mechanism cannot be used to individually brake each ring-like rotary member.

When the ring-shaped rotary ring is synchronously rotated at a maximum rotational speed of a traveller the ring-shaped rotary member overruns in a movement of a thread in each chase of a cop. When the overrun of the ring-shaped rotary member is generated, a ballooning tension of a thread between a snarl wire and a traveller changes remarkably irregularly, resulting in breakage of the thread in spinning. Further, it must be noted that the irregularity of the ballooning tension of the thread differs for each spindle. Therefore when the rotation of the spindle increases to a high value, e.g., 20,000 r.p.m. or 25,000 r.p.m., it becomes to necessary to individually control the rotation of each ring-shaped rotary member, to obtain a thread having a superior quality under a staple spinning condition.

From the above-described viewpoint, the same applicant as that of the present application proposed a braking mechanism comprising a ring-shaped rotary member having a braking shoe capable of bending toward a lower end of a holder supporting, through a bearing, the ring-shaped rotary member, in Japanese Examined Patent Publication No. 63-42009 published on Aug. 19, 1988. The braking shoe can be brought into contact with the lower end of the holder when a rotation of the ring-shaped rotary member exceeds the predetermined value, and accordingly, it is possible to individually control the rotation of each ring-shaped rotary member in the spinning frame. Since the rotational speed at which the braking shoe comes into contact with the holder can be optionally selected according to a material of the braking shoe, and selecting the width of a gap between the lower end face of the holder and an upper face of the braking shoe or the like, it is possible to determine a maximum rotational speed of the ring-shaped rotary member by suitably selecting the above conditions. Nevertheless, this braking mechanism has still another disadvantage in that a difference between a rotational speed of the spindle and the rotational speed of the ring-shaped rotary member depends on the rotational speed of the spindle. For example, even if the difference between the rotational speed of the spindle and the rotational speed of the ring-shaped rotary member is kept constant by suitably selecting the conditions of the braking shoe, when the spinning frame is stopped, the spindle can be stopped in a relatively short time, but the rotation of the ring-shaped rotary member is continued for a relatively long time due to a rotational inertia of the ring-shaped rotary member, and this results in an overrun of the ring-shaped rotary member and a generation of a snarl in the thread. Accordingly, it is possible to provide a braking mechanism enabling a rotation of the spindle at up to 20,000 r.p.m., and to keep the rotational speed of the ring-shaped rotary member constant, e.g., at 12,000 r.p.m., with the above-mentioned, braking mechanism, but to avoid the generation of an overrun of the ring-shaped rotary member when the spinning frames are stopped, the rotational speed of the ring-shaped rotary member must be allowed to fall to about 5,000 r.p.m. to 6,000 r.p.m.

To eliminate this disadvantage of the braking mechanism disclosed in Japanese Examined Patent Publication No. 63-42009, the same applicant as that of the present application further proposed an improved braking mechanism in which a contact area between the lower end face of the holder and the upper face of the braking shoe can be adjusted according to a value of the rotational speed of the ring-shaped rotary member, in Japanese Patent Application No. 1-122024 filed on May 15, 1989.

This improved braking mechanism will be explained in detail with reference to FIGS. 7 and 8.

FIG. 7 shows an axial cross sectional view of an example of the improved braking mechanism, and FIG. 8 shows another cross sectional view of another example thereof.

A braking shoe 125 shown in FIG. 7 is comprised of a vertical portion 51, a bending portion 53, and an inclining portion 52; an upper face of the inclining portion 52 being a flat plane. A lower end face 48 of a holder 11 shown in FIG. 7 is a curved face. Conversely, in a braking shoe 126 shown in FIG. 8, an upper face of an inclining portion 54 is a curved face, and a lower end face 49 of a holder 11 shown in FIG. 8 is a flat plane.

When a ring-shaped rotary member 13 is rotated and a rotational speed of the ring-shaped rotary member 13 is increased, a centrifugal force applied to the inclining portion 52 or 54 is increased, and thus the inclining portion 52 or 54 is turned about the bending portion 53 from the position 125 illustrated by a solid line to the position 125' illustrated by a two-dot-chain line in FIG. 7, and from the position 126 illustrated by a solid line to the position **126*a* illustrated by a two-dot-chain line or the position 126*b*** illustrated by another two-dot-chain line.

The inclining portion, i.e., the portion 52 or 54, is made of a resilient material, and accordingly, a bending angle of the inclining portion about the bending portion can be changed according to the centrifugal force, i.e., the rotational speed of the ring-shaped rotary member, and thus a contacting area between the upper face of the inclining portion 52 or 54 and the lower end face of the holder is changed according to the rotational speed of the ring-shaped rotary member, resulting in an increase of a braking force therebetween. This phenomenon is clearly illustrated in FIG. 8 and the inclining portion having a posture shown by the inclining portion **126*a* when the rotational speed of the ring-shaped rotary member is relatively lower is changed to a posture shown by the inclining portion 126*b*** when the inclining speed of the ring-shaped rotary member becomes high. Consequentially, this improved braking mechanism can brake the rotation of the ring-shaped rotary member over a broad speed range compared with the conventional rotary ring described herebefore, and prevent the generation of an overrun of the ring-shaped rotary member when the spinning frame is stopped and the rotation of the ring-shaped rotary member is continued due to an inertia thereof.

Nevertheless, this improved braking mechanism has another disadvantage. Namely, since a time for which the inclining portion is contact with the holder and a continuous friction therebetween is also long, in this braking mechanism, the inclining portion is likely to be abraded when using this braking means for a long period, e.g., several years. Further this improved braking mechanism can brake the ring-shaped rotary member so that the rotational speed thereof is suitably controlled over a broad speed range, as described above, but it is impossible to absorb an irregularity of the thread tension of the thread during spinning by this improved braking mechanism, after the inclining portion is completely in contact with the holder. The reason for this phenomenon appears to be that, since a resilient material is used as the inclining portion of the braking shoe; the friction in the rotational direction of the ring-shaped rotary member between the holder and the ring-shaped rotary member is large, and a braking force cannot precisely compensate for the rotational speed of the ring-shaped rotary member.

SUMMARY OF THE INVENTION

An object of the present invention is to provide a rotary ring for spinning including a braking mechanism capable of individually controlling a rotational speed of a ring-shaped rotary member in a broad speed range thereof, preventing an over run of the ring-shaped rotary member when the spinning frame is stopped, and increasing the life thereof.

Another object of the present invention is to provide a rotary ring for spinning including a braking mechanism further capable of uniformly controlling an irregularity of the thread tension of the thread in spinning.

The object of the present application is attained by a rotary ring for spinning comprising a holder, a ring-shaped rotary member supported rotatably, through a bearing, inside the holder, and a braking shoe having an upper portion, fixed to a lower end of the ring-shaped rotary ring member, and a lower portion extended in a conical shape from the upper portion thereof toward a space below a lower end face of the holder, and constituted in such a manner that, when the ring-shaped rotary ring member is rotated, the lower portion can be resiliently bent upward and brought into contact with the lower end face of the holder by a centrifugal force caused by the rotation of the ring-shaped rotary member, characterized in that a braking runner having a substantially annular shape, an inside and lower edge of which is supported with the braking shoe, and capable of moving in an axial direction of the ring-shaped rotary member, is provided in a space between the lower end face of the holder and the braking shoe, whereby when the ring-shaped rotary member is rotated, the braking means brakes the ring-shaped rotary member through the braking runner.

In the rotary ring in accordance with present invention, when the braking shoe is rotated with the ring-shaped rotary member, the lower portion having the resiliently deformable property of the braking shoe can be raised upward by a vertical component of a centrifugal force caused by the rotation of the ring-shaped rotary member. When the braking runner is moved upward by the deformation of the braking shoe, and the rotational speed of the ring-shaped rotary member is increased to a value determined by a constitution of the braking shoe and the braking runner and a distance between a lower end face of the holder and an upper face of the braking runner, the braking runner comes into contact with the holder, and a pulling down force is exerted on the ring-shaped rotary member by a force pushing the holder. Since the ring-shaped rotary member is supported, through the bearing, with the holder, the holder is pinched by the bearing and the braking runner, and a braking force braking the rotation of the ring-shaped rotary member is generated by a friction between the bearing and the ring-shaped rotary member and a friction between the holder and the braking runner. When the rotational speed of the ring-shaped rotary member is increased against a frictional resistance between the braking runner and the holder, the lower portion of the braking shoe tends to rise further upward, due to the centrifugal force applied thereto, resulting in an increase of the pushing force of the lower portion of the braking shoe through the braking runner against the holder, and accordingly the braking force against the ring-shaped rotary member is increased.

DESCRIPTION OF THE PREFERRED EMBODIMENTS

Figure 1:
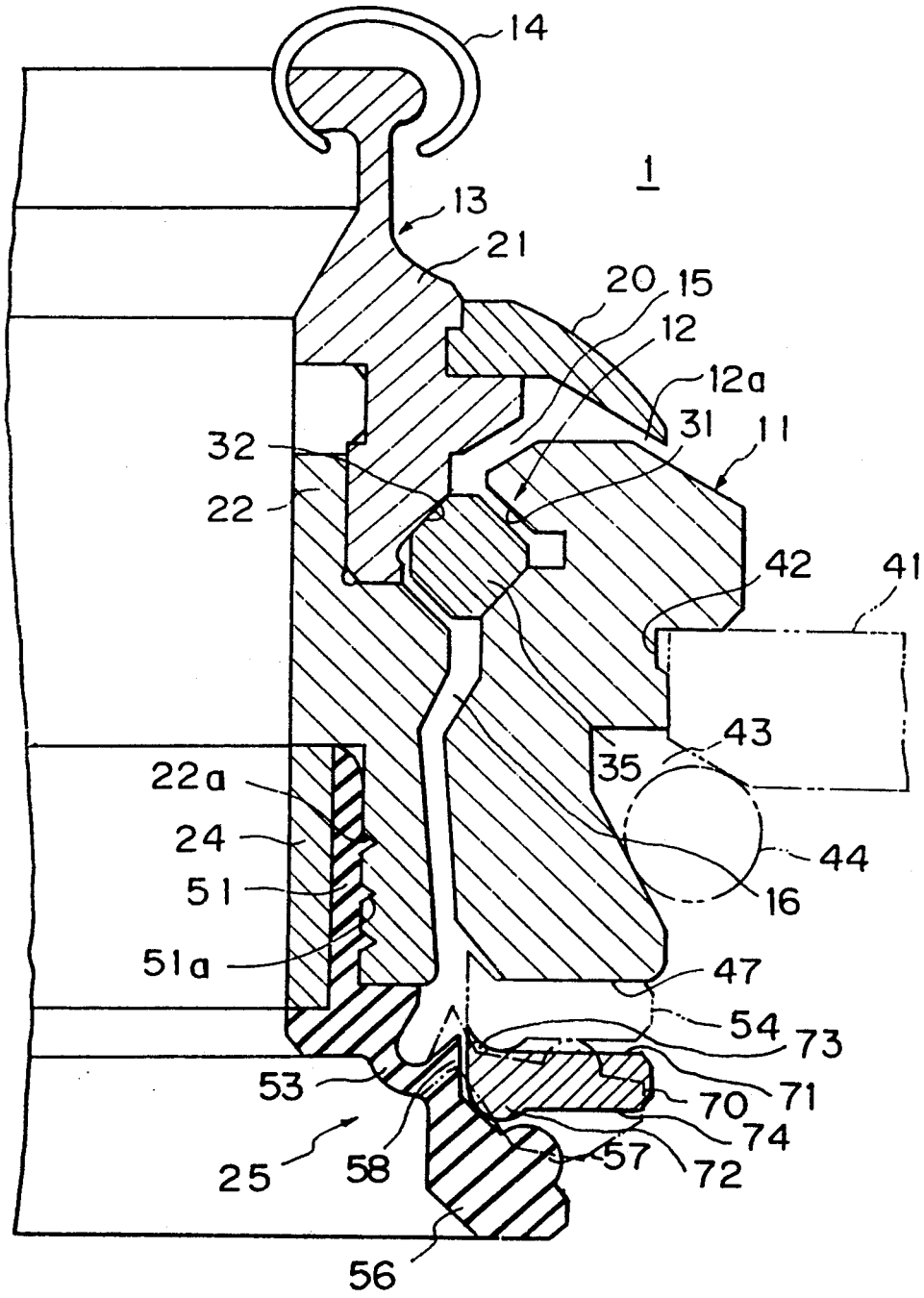
FIG. 1(A) is an axial cross sectional view of a first embodiment of a rotary ring for spinning in accordance with the present invention.
FIG. 1(B) is a partially cutaway perspective view of an embodiment of a braking runner used in the rotary ring for spinning illustrated in FIG. 1(A)
FIG. 1(C) is a partially cutaway perspective view of an embodiment of a braking shoe used in the rotary ring for spinning illustrated in FIG. 1(A)
Figure 1:
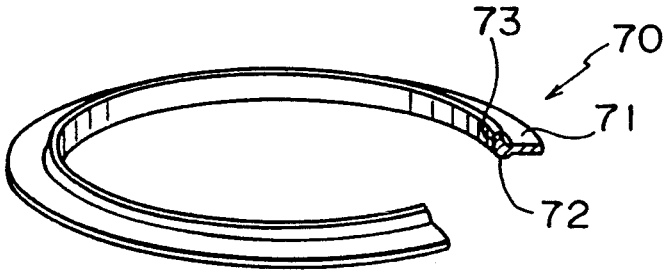
Figure 1:
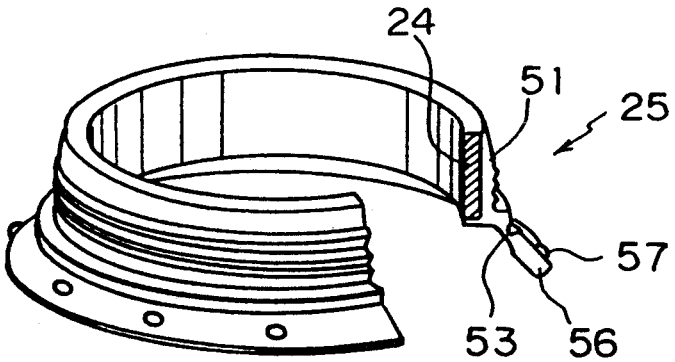

The present invention will now be described in detail with reference to the accompanying drawings illustrating embodiments thereof.

Various types of rotary rings for spinning in accordance with the present invention may be used for manufacturing a thread having a superior quality with, if necessary, a higher rotational speed of a spindle in a spinning frame. Accordingly, six typical types of rotary ring for spinning are described in detail with reference to the drawings. In the drawings, the same reference numbers are used for commonly shown members to simplify the explanation thereof.

A first embodiment of a rotary ring for spinning in accordance with the present invention is illustrated in FIGS. 1(A), 1(B) and 1(C). An axial cross sectional view thereof is illustrated in FIG. 1(A), a partially cutaway perspective view of an embodiment of a braking runner used in the rotary ring for spinning is illustrated in FIG. 1(B), and a partially cutaway perspective view of a braking shoe used in the rotary ring for spinning is illustrated in FIG. 1(C).

As shown in FIG. 1(A), a rotary ring 1 is comprised of a holder 11 and a ring-shaped rotary member 13 supported rotatably through a bearing 12 by a holder 11. The ring-shaped rotary member 13 is comprised of a flange rotor 21 on which a traveler 14 can run, a lower rotor 22 mounted on a lower inside portion of the flange rotor 21, as one body, a braking shoe 25 firmly mounted on a lower inside portion of the lower rotor 22, a pressing ring 24 arranged on an inside of the braking shoe 24, to fix the braking shoe 25 to the lower rotor 22, a braking ring 70 freely mounted on the braking shoe 25 and capable of moving in a vertical direction, and a dust cover 20.

The bearing 12 is comprised of a V groove 32 arranged on an outer peripheral surface of the ring-shaped rotary member 13, a V groove 31 arranged on an inner peripheral surface of the holder 11, and an annular sliding ring 35 mounted in a space constituted by the two above grooves, in such a manner that the ring-shaped rotary member can be freely rotated through minute air gaps formed between the annular sliding ring and the two grooves.

Figure 5A:
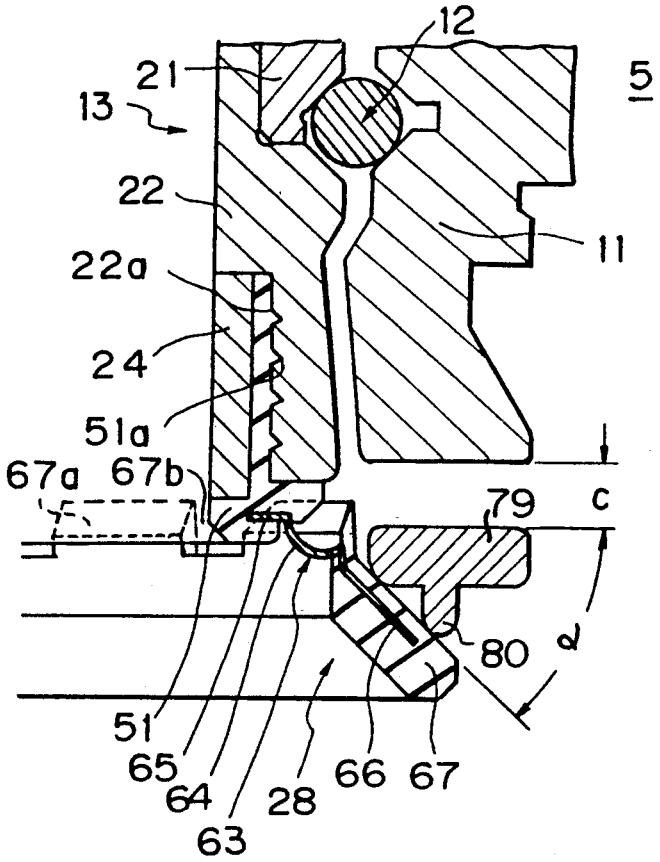
FIG. 5(A) is a partial axial cross sectional view of a fifth embodiment of a rotary ring for spinning in accordance with the present invention.
Figure 6A:
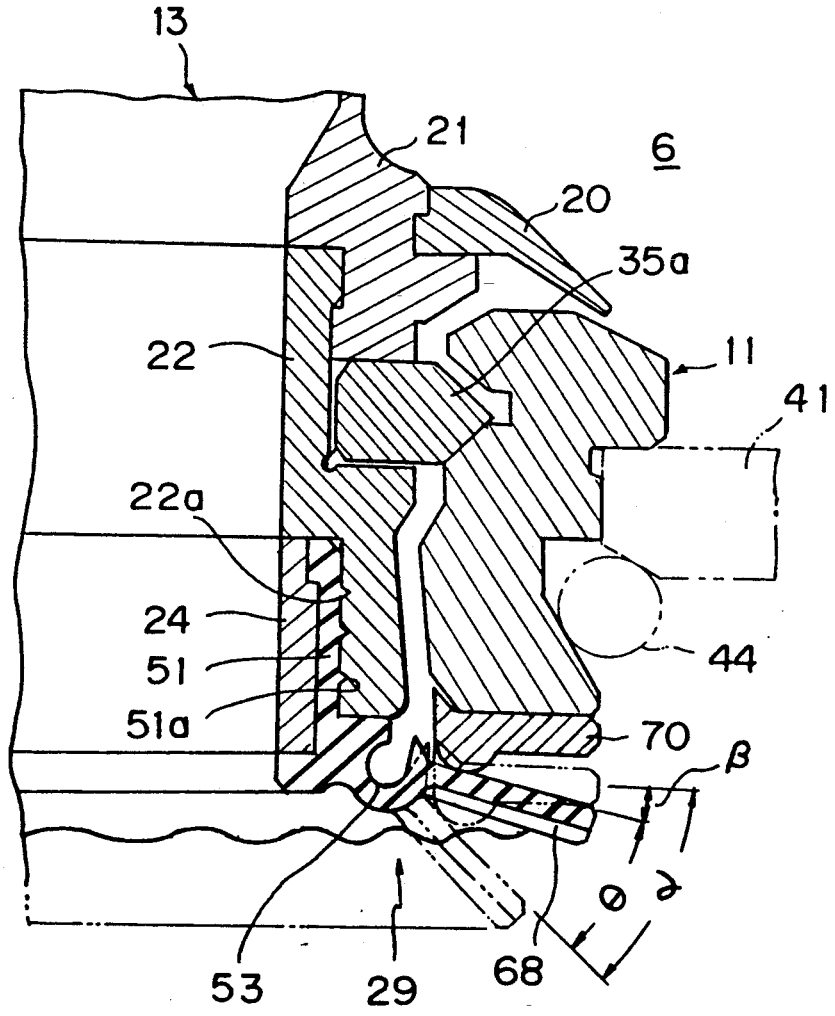
FIG. 6(A) is an axial cross sectional view of a sixth embodiment of a rotary ring for spinning in accordance with the present invention.
Figure 6:
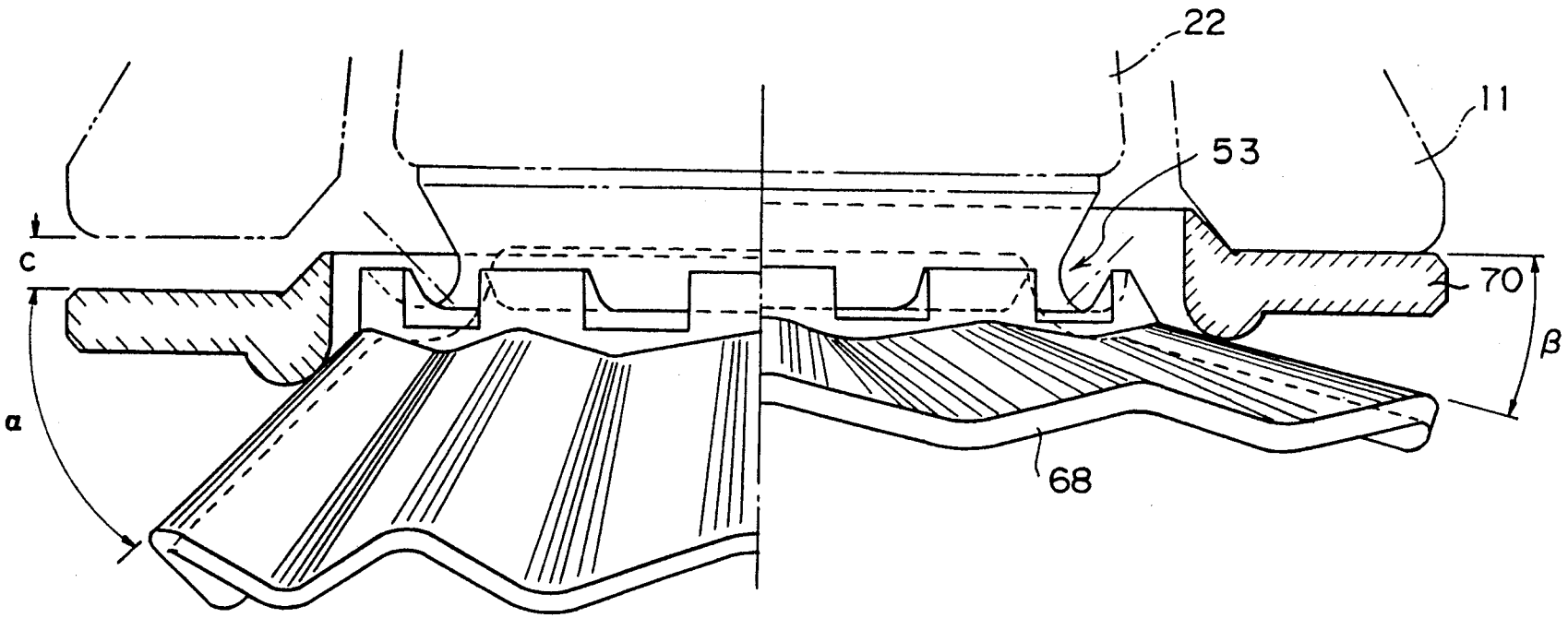
FIG. 6(B) is a front view illustrating a relationship of a braking shoe and a braking runner used in the rotary ring for spinning illustrated in FIG. 6(A), in which a right half portion shows the braking shoe when the ring-shaped rotary member is rotated and an inclining portion is bent upward, and a left half portion shows the braking shoe when the ring-shaped rotary member is at a standstill.
Figure 7:
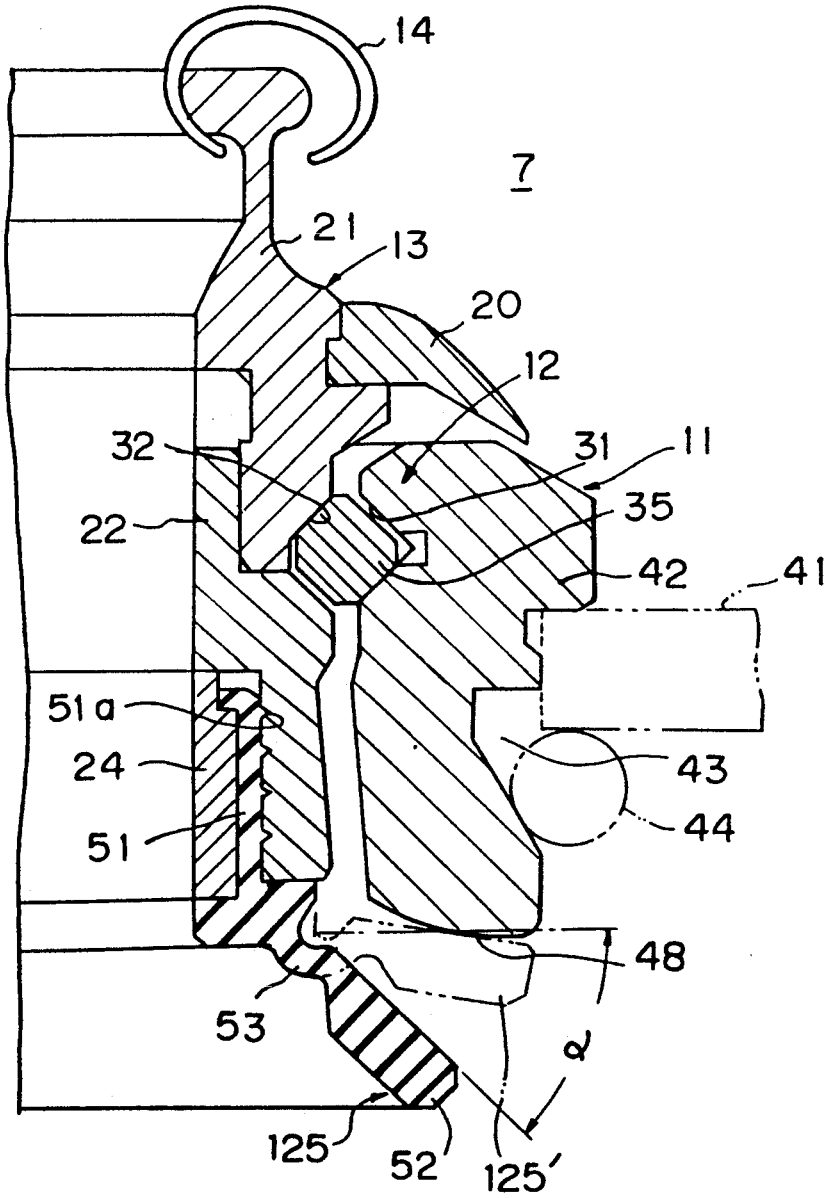
Fig. 7 (PRIOR ART)
FIG. 7 is an axial cross sectional view of a conventional rotary ring for spinning in which a ring-shaped rotary member equipped with a braking shoe having a resiliently deformable inclining portion is used.
Figure 8:
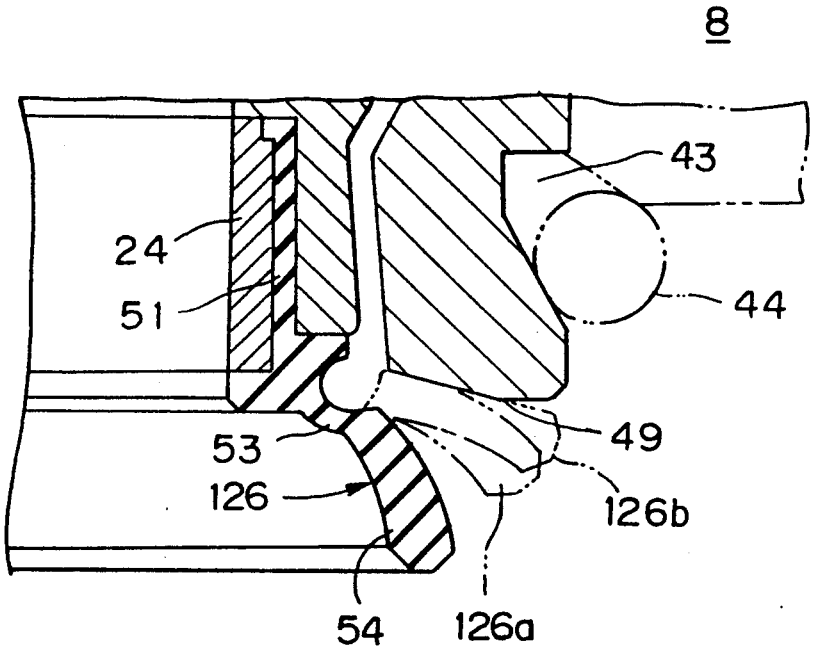
Fig. 8 (PRIOR ART)
FIG. 8 is an axial cross sectional view of another conventional rotary ring for spinning in which a ring-shaped rotary member equipped with a braking shoe having a resilient deformable inclining portion is used.

An annular sliding ring 35 having a substantially diamond cross section can be used in the rotary ring shown in FIG. 1(A), but an annular sliding ring having another cross section, for example an annular sliding ring having a circular cross section shown in FIG. 5(A) illustrating a fifth embodiment of rotary ring in accordance with the present invention, or an annular sliding ring having a substantially pentagonal cross section shown in FIG. 6(A) illustrating a sixth embodiment of a rotary ring in accordance with the present invention, can be used.

The holder 11 with the ring-shaped rotary member 13 is inserted to a hole 42 of a ring rail 41 of the spinning frame and is fixed to the ring rail 41 by mounting a stop ring 44 in a circumferential groove 43 provided on an outer circumferential wall of the holder 11. A sliding face 47 having a ring-like horizontal surface is formed on a lower end face of the holder 11 in the rotary ring shown in FIG. 1(A). Note, a ring-like inclined surface having the same inclining angle over all the lower end of the holder can be used in place of the ring-like horizontal surface.

The braking shoe 25 has a ring-like shape having a lower portion which extends outward as clearly shown in FIG. 1(C) and is comprised of a vertical portion 51 to be fixed to the lower and inside portion of the lower, rotor 22, a bending portion 53 extending from a lower end of the vertical portion 51, and an inclining portion 56 extending outward and downward in a conical shape from the bending portion 51 as shown in FIGS. 1(A) and 1(C). The vertical portion 51 has a cylindrical shape, and an outer circumferential face thereof is provided with three circular protrusions 51*a* capable of being inserted to a corresponding circular groove 22*a* arranged on the lower inside portion of the lower rotor 22. Accordingly the braking shoe 25 can be firmly fixed to the lower inside portion of the lower rotor 22 by engaging the each circular protrusion 51*a* of the vertical portion 51 with the corresponding circular groove 22*a* of the lower rotor 22 and fitting a pressing ring of a stiff material, such as, for example, a metal and having a circular shape, thereto.

The bending portion 53 of the braking shoe is formed as an outwardly concave shape in a vertical cross section along a rotational axis of the ring-shaped rotary member, and thus the inclining portion 56 can be bent upward about the bending portion 53.

All of the portions of the braking shoe 25 used in the rotary ring in the first embodiment shown in FIGS. 1(A) and 1(C) are made of a resilient material, but as described in the other embodiments, it is possible to select another constitution for the braking shoe and only at least the bending portion and the inclining portion need be formed of the resilient material.

It is preferable to use a resilient material having a shore hardness of between 50° and 80°. The suitable hardness of the resilient material of the braking shoe depends on a rotational speed of the ring-shaped rotary member 13. Namely when the braking operation of the braking shoe is to start from a relatively lower rotational speed, e.g., 6000 r.p.m. of the ring-shaped rotary member, a breaking shoe made of the resilient material having a relatively lower hardness value and a high elastic recovery is preferably used, and when the braking operation of the braking shoe is to start at a relatively high rotational speed, e.g., 8000 r.p.m., of the ring-shaped rotary member, the braking shoe should be made of the resilient material having a relatively higher hardness value.

A material suitable for use as the resilient material for the ring-shaped rotary member is a synthetic rubber such as a urethane rubber and a fluoro rubber, a synthetic resin having a superior softness, a high elastic recovery and a high resistance to heat, such as a urethane resin and a polyester resin, or a synthetic resin as described before and including an additive capable of reducing a friction coefficient of the ring-shaped rotary member, increasing a resistance to abrasion thereof, and improving an elastic recovery thereof, such as a molybdenum disulfide, a polytetrafluoroethylene, a carbon, and a silicon wax.

As described above, the inclining portion 56 is made of the resilient material, and accordingly when the ring-shaped rotary member 13 is rotated and the rotational speed of the ring-shaped rotary member 13 reaches the predetermined value, the inclining portion 56 can be bent upward about the bending portion 53 by a centrifugal force applied to the inclining portion 56, and a peripheral portion of the inclining portion 56 is expanded in a circular direction. The size and weight of the inclining portion 56 are suitably determined in such a manner that, when the ring-shaped rotary member 13 is rotated, a suitable centrifugal force is applied to the inclining portion 56 to raise the inclining portion 56 and apply a necessary pressing force to the braking ring 70. Accordingly, a thickness of the inclining portion 56 is generally thicker than a thickness of the bending portion 53.

As shown in FIGS. 1(A) and 1(C), twelve protrusions 57 having a semispherical shape are spaced equal distant from each other on the same radius from a rotational axis of the ring shaped rotary member of an upper face of the inclining portion 56 of the braking shoe 25. These protrusions 57 are used for maintaining the braking runner 70 in a horizontal plane when the inclining portion 56 is in contact with the braking runner 70.

An annular protrusion 58 having an outer diameter which is slightly smaller than an inner diameter of the braking runner is provided in an area from an upper end of the inclining portion 56 to the bending portion 53 of the braking shoe 25, to prevent an irregular movement in a radial direction of the braking runner. An annular protrusion having a plurality of cutaway portions thereon can be used in place of the annular protrusion 58 to enable to easily bend the annular protrusion and to easily arise the braking runner.

The braking runner 70 in the first embodiment has a smooth upper surface 71, a lower annular protrusion 72 arranged on a lower inside portion thereof and an upper annular protrusion 73 having a triangular cross section. The upper surface 71 of the braking runner 70 must be smooth, to maintain a smooth sliding operation between the lower end face 47 of the holder 11 and the upper surface 71 of the braking runner when the braking runner 70 is in contact with the holder 11. The lower annular protrusion 72 maintains a posture of the braking runner 70 in a horizontal plane during the rotation thereof. When the braking runner 70 having the upper protrusion is used, a lower and inner corner of the holder 11 is cut to a truncated cone shape, and preferably an angle of a hypotenuse of the triangular cross section against a horizontal plane is smaller than an angle of an inner surface of the corner cut to the truncated cone shape of the holder 11 against the horizontal plane. The above construction of the holder 11 and the braking runner 70 makes it possible to suitably guide the braking runner 70 along the inner surface of the corner cut to the truncated cone shape of the holder, and prevent an irregular movement in a radial direction of the braking runner 70.

As described above, the braking runner 70 rotates while sliding on the lower end face of the holder 11 made of a metal. Accordingly, the braking runner 70 is preferably formed from a material having a lower coefficient of friction and superior resistance to heat and abrasion. The material may be a polyimide resin, a polyamide-imide resin, a tetrafluoride resin including a carbon fiber, a filler or the like, or a fine ceramic.

In the rotary ring for spinning in accordance with the present invention, preferably a dust cover 20 of a resilient material having a plurality of small grooves inclined toward an outer peripheral edge thereof (not shown) on a lower side thereof, and extending toward an upper area from an top end of the holder to cover an upper cylindrical gap 15 between the ring-shaped rotary member 13 and the holder 11, is fixed on an upper and outer peripheral edge of the ring-shaped rotary member, and a small gap 12*a* is maintained between an upper peripheral edge of the dust cover 20 and the top end of the holder 11. The ingress of dust, such as extremely short fibers or the like, into the gap 15 between the ring-shaped rotary member 13 and the holder 11 is prevented by providing the dust cover 20, and even if the dust is entrained into the gap 15, it is possible to remove the dust from the gap 15 to the outside by a centrifugal force applied to the dust to force it through the swirl-like grooves arranged on the lower side of the dust cover 20.

To enhance the removal of the dust from a gap between the ring-shaped rotary member 13 and the holder 11, preferably the upper cylindrical gap 15 and a lower cylindrical gap 16 extending between the ring-like rotary member 13 and the holder 11 and having a larger cross section compared with that of the air gap around the bearing extend in a taper shape so that each diameter of the cylindrical gaps 15 and 16 is increased upward or downward from a portion of the air gap around the bearing 12.

Figure 2:
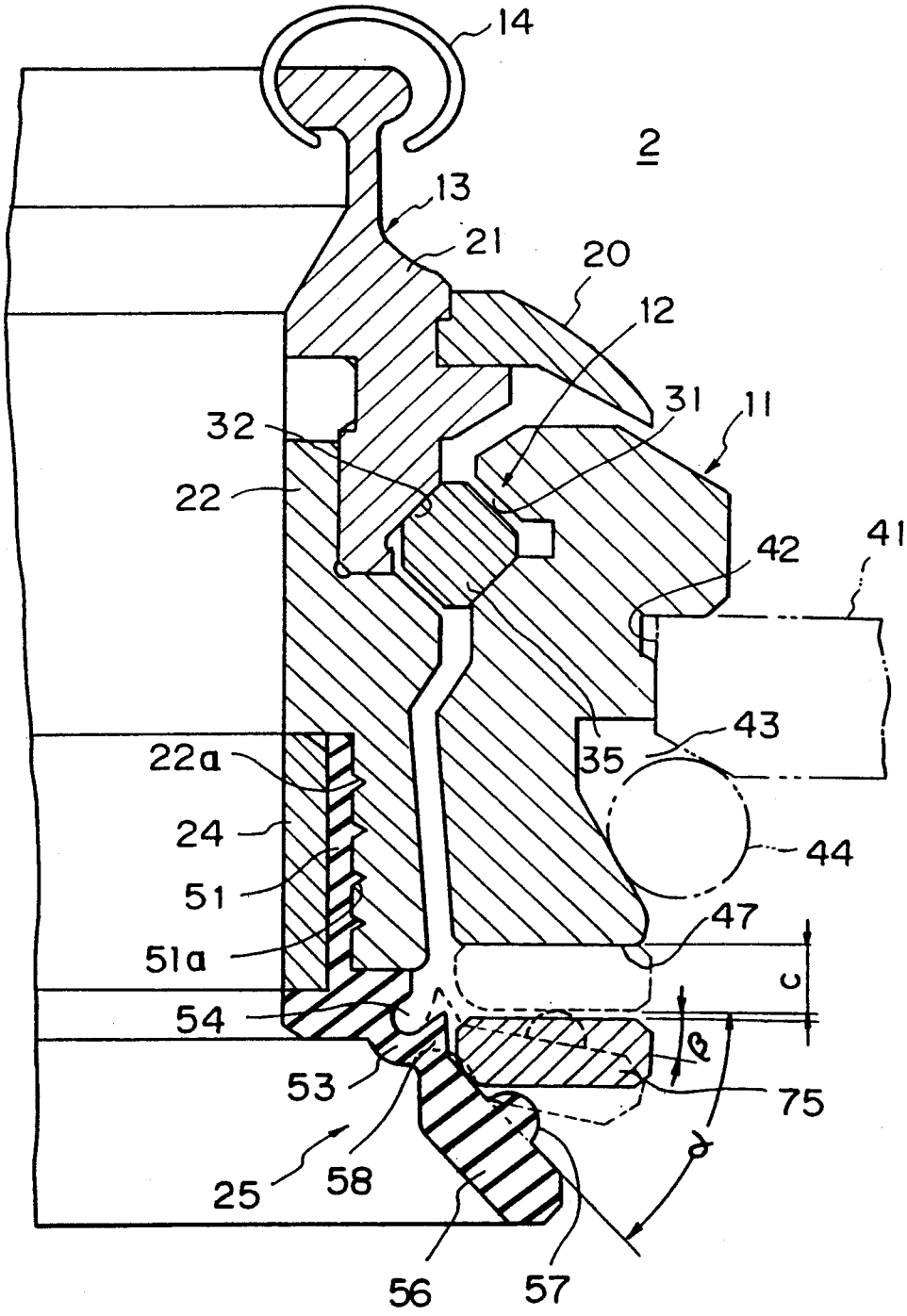
FIG. 2 is an axial cross sectional view of a second embodiment of a rotary ring for spinning in accordance with the present invention.

A second embodiment of a rotary ring for spinning in accordance with the present invention is illustrated in FIG. 2. In this embodiment, a braking shoe 25 having the same structure as that used in the first embodiment is used, and only the structure of a braking runner 75 differs from that of the braking runner 70 used in the first embodiment. The remaining structure of the rotary ring for spinning is the same as used in the first embodiment. Namely, both the upper and lower sides in a cross section of the braking runner 75 are formed as a smooth plane, and an upper protrusion and lower protrusion are not provided. This braking runner 75 is the most simple example thereof, and it is possible to attain the object of the present invention by suitably determining the dimensions of the braking runner 70 for a specific spinning condition.

An operation of the rotary ring for spinning in accordance with the present invention will be described hereafter.

When a spindle (not shown) is rotated, the ring shaped rotary member 13 is rotated by a torque from a sliding friction given by a traveller 14 running on the ring flange 21 of the ring-shaped rotary member 13. As well known, the rotational movement of the traveller 14 is due to a rotational and winding movement of a thread supplied from a draft mechanism and wound on a bobbin mounted on a spindle of a spinning frame. The braking shoe 25 fixed on the ring-shaped rotary member 13 is also rotated, and the inclining portion 56 of the braking shoe 25 is raised upward about the bending portion 53 by a centrifugal force generated by the rotation of the ring-shaped rotary member 25. At that time, a peripheral portion of the inclining portion is developed in such a manner that a posture of the inclining portion becomes nearly horizontal.

A posture of the inclining portion 56 and a position of the braking runner 70 or 75 in the first embodiment and the second embodiment are shown by a solid line, respectively, when the ring-shaped rotary member is at a standstill, and are shown by two-dot-chain lines, respectively when the ring-shaped rotary member is rotated and the inclined portion is raised upward, in FIGS. 1(A) and 2.

Namely, when the ring-shaped rotary member 13 is rotated, the braking runner 70 starts to rise in a vertical direction by the inclining portion 56 in contact with a lower and inner edge of the braking runner 70, and the braking runner 70 is further raised in a horizontal posture by the protrusion 57 in contact with the lower face 74 of the braking runner 70, according to an increase of the rotational speed of the ring-shaped rotary member 13 and an increase of a bending angle of the inclining portion 56 of the braking shoe 25 thereof. When the angle between the horizontal plane and the upper face of the inclining portion 56 of the braking shoe 25 becomes $\beta$, an upper face of the braking runner 70 that has been moved upward comes into contact with the lower end face of the holder 11, a frictional force is generated between both faces, and a braking force caused by the frictional force is applied to the ring-like rotary member 13 to suitably control the rotational speed of the ring-shaped rotary member 13, to thereby keep the rotational speed of the ring-like rotary member at a lower value than that of the traveller. In practice, when the braking runner 70 is raised upward, the ring-shaped rotary member 13 is pulled down, and thus a frictional force is applied between the bearing 12 and the holder 11. Namely, a state in which the holder 11 is pinched by the bearing 12 and the braking runner 70 is generated, and the braking force brakes the ring-shaped rotary member 13.

The protrusion 57 provided on the upper face of the inclining portion 56 maintains a posture of the braking runner 70 in a horizontal plane, and the protrusions 73 of the braking runner 70 and the protrusions 58 of the inclining portion 56 of the braking shoe 25 prevent an irregular movement in a radial direction of the braking runner 70.

When the rotational speed of the ring-shaped rotary member 13 is increased after the braking runner 70 comes into contact with the holder 11, a pressing force of the braking runner 70 against the holder 11 is increased, which results in an increase of the braking force of the braking runner 70.

Figure 9:
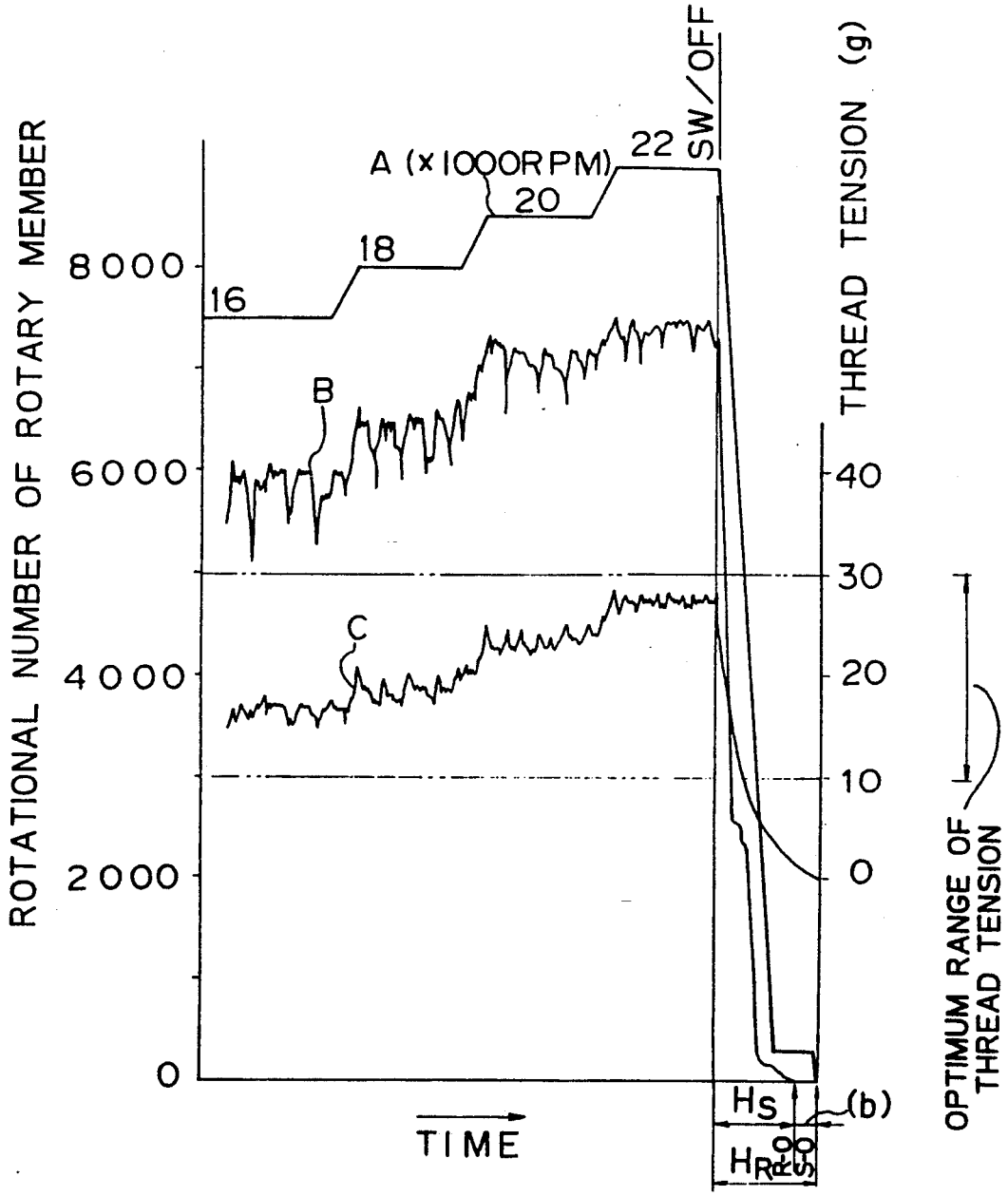
FIG. 9 is a graph illustrating a relationship between a rotational speed of a spindle, a rotational speed of a ring-shaped rotary member, and a thread tension when a thread is spun by a spinning frame with a ring-shaped rotary member in accordance with the present invention.
Figure 10:
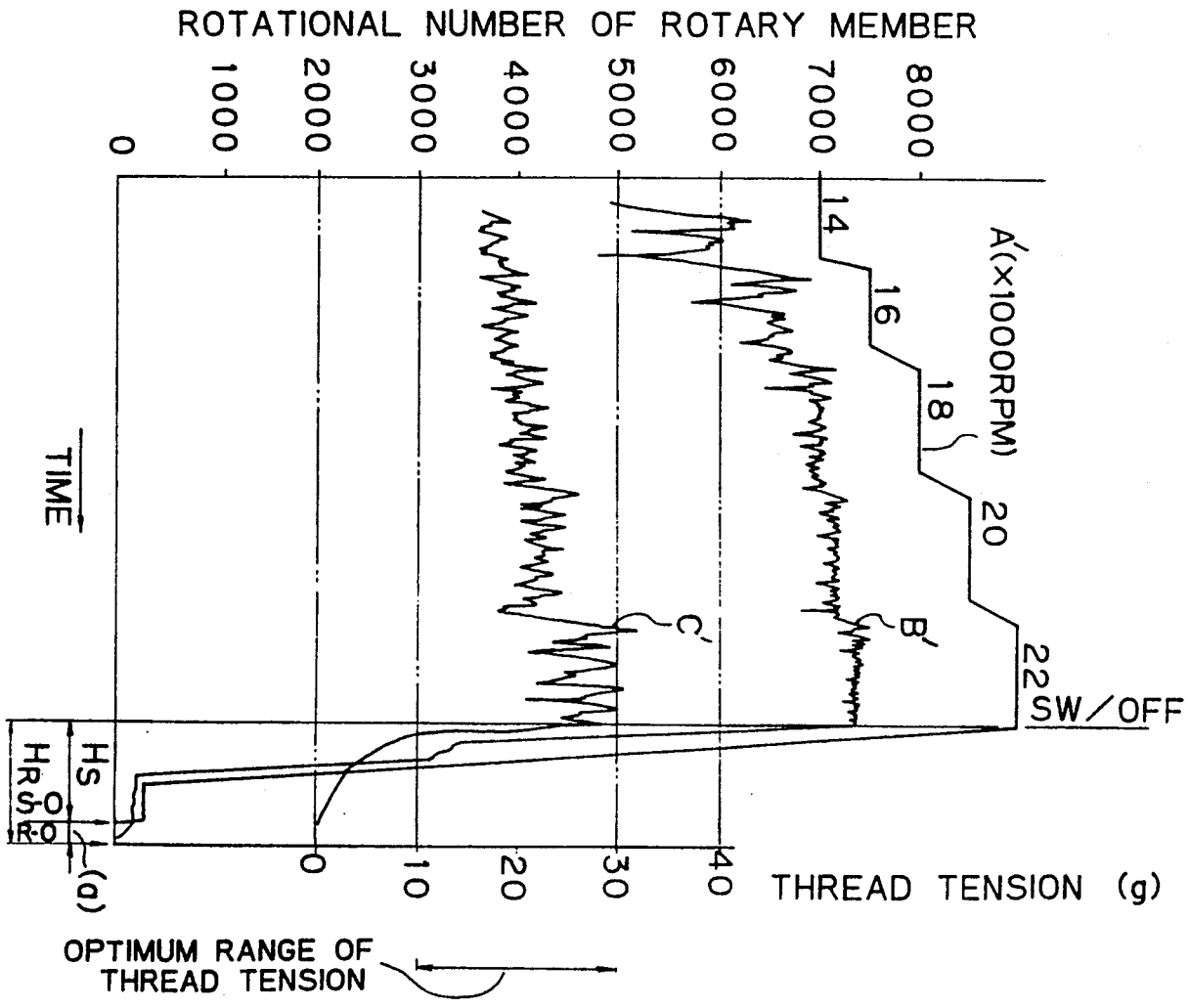
Fig. 10 (PRIOR ART)
FIG. 10 is a graph illustrating a relationship between a rotational speed of a spindle, a rotational speed of a ring-shaped rotary member, and a thread tension when a thread is spun by a spinning frame with a conventional ring-shaped rotary member.

Effects of the rotary ring in accordance with the present invention will be described with reference to FIGS. 9 and 10 illustrating the relationship between a rotational speed of a spindle, a rotational speed of a ring-shaped rotary member and a thread tension when a thread is spun by a spinning frame with a ring-shaped rotary member in accordance with the present invention (FIG. 9), and when a thread is spun by a spinning frame with a conventional ring-shaped rotary member having no braking runner and in which a contact between the braking shoe and the holder is generated in a short time.

FIGS. 9 and 10 were prepared so that the above relationship between the three factors can be easily understood by summarizing many experiments for the spinning frames equipped with a rotary ring in accordance with the present invention and the conventional rotary ring. Namely, a rotational speed of a spindle is increased step by step from 16,000 r.p.m to 22,000 r.p.m. In practical use of the spinning frame, the maximum rotational speed of the spindle, i.e., 22,000 r.p.m, is held in a long time, to spin a thread to be wound on a cop. An abrupt start and abrupt stop of the rotation of spindle usually causes thread breakage, and accordingly a step-like start or stop are often used, by using an inverter for an electric motor, in the practical operation of the spinning frame now used. In the case of FIGS. 9 and 10, however, the spinning frame is abruptly stopped (switched off) at the highest rotational speed of the spindle. As can be easily understood when comparing each wave of the thread tension when the spindle rotates at the rotational speed of 22,000 r.p.m, the irregularity of the thread tension in the rotary ring in accordance with the present invention is smaller than that in the conventional rotary ring, and this means that the thread tension can be controlled in a narrow range in the spinning frame equipped with the rotary ring in accordance with the present invention, compared with the use of the conventional rotary ring.

Problems generated when the spinning frame is stopped will be explained with reference to FIGS. 9 and 10.

As shown in FIGS. 9 and 10, in the spinning frame equipped with the rotary ring in accordance with the present invention, a period $H_R$ required to stop the ring-shaped rotary member after a switch for a motor driving the spindle is opened is shorter than a period $H_S$ required to stop the spindle after the switch of the motor is opened. Accordingly, a generation of an overrun of the ring-shaped rotary member can be prevented, and there is no chance generating a snarl of the thread. In the spinning frame equipped with the usual rotary ring, a period $H_R$ required to stop the ring-shaped rotary member after a switch of a motor for driving the spindle is opened is longer than a period $H_S$ required to stop the spindle after the switch of the motor is opened. Accordingly, an overrun of the ring-shaped rotary member is generated and many snarles appear in the thread.

FIGS. 9 and 10 further teach that a wave of the ring-shaped rotary member at the rotational speed of the spindle of 22,000 r.p.m, in the rotary ring in accordance with the present invention, is coarse compared with that in the conventional rotary ring. This means that the conventional rotary ring cannot control the ring-shaped rotary member at the rotational speed of the spindle of over 20,000 r.p.m, but the rotary ring in accordance with the present invention still has a margin in which the spindle and the ring-shaped rotary member can be rotated at a higher rotational speed.

Further, since a braking runner is used in the present invention, an abrasion and heat generation of the braking shoe is remarkably decreased.

The timing of when the inclining portion 56 of the braking shoe 25 is through the braking runner comes into contact with the holder 11 can be adjusted by adjusting a distance C between the upper face of the braking runner 70 and the lower end face of the holders 11 when the spindle is at a standstill, by changing the thickness of the braking runner or by adjusting a flexibility of the inclining portion 56 of the braking shoe 25 by changing a material used to manufacture the braking shoe 25 or the other conditions. Accordingly, the rotary ring in accordance with the present invention provides a broad range of control of the rotational speed of the ring-shaped rotary ring, compared with the conventional ring-shaped rotary ring.

The inclining portion 56 of the braking shoe 25 is preferably formed in such a manner that an angle between a horizontal plane and an upper face of the inclining portion 56 is between 30° and 60° when the ring-shaped rotary member is stationary, and a weight balance in the inclining portion 56 is determined under conditions including a type or a thread count of a thread to be spun, a rotational speed of the spindle, a diameter of the ring-shaped rotary member, a material used for manufacturing the braking shoe or the like.

The other four embodiment, i.e., from the third embodiment to the sixth embodiment of the rotary ring for spinning in accordance with the present invention, will be described hereafter. Note, since the essential structure of the rotary ring in the four embodiments is identical to the rotary ring described in the first embodiment, only a portion or portions differing from the first embodiment are described hereafter.

Figure 3:
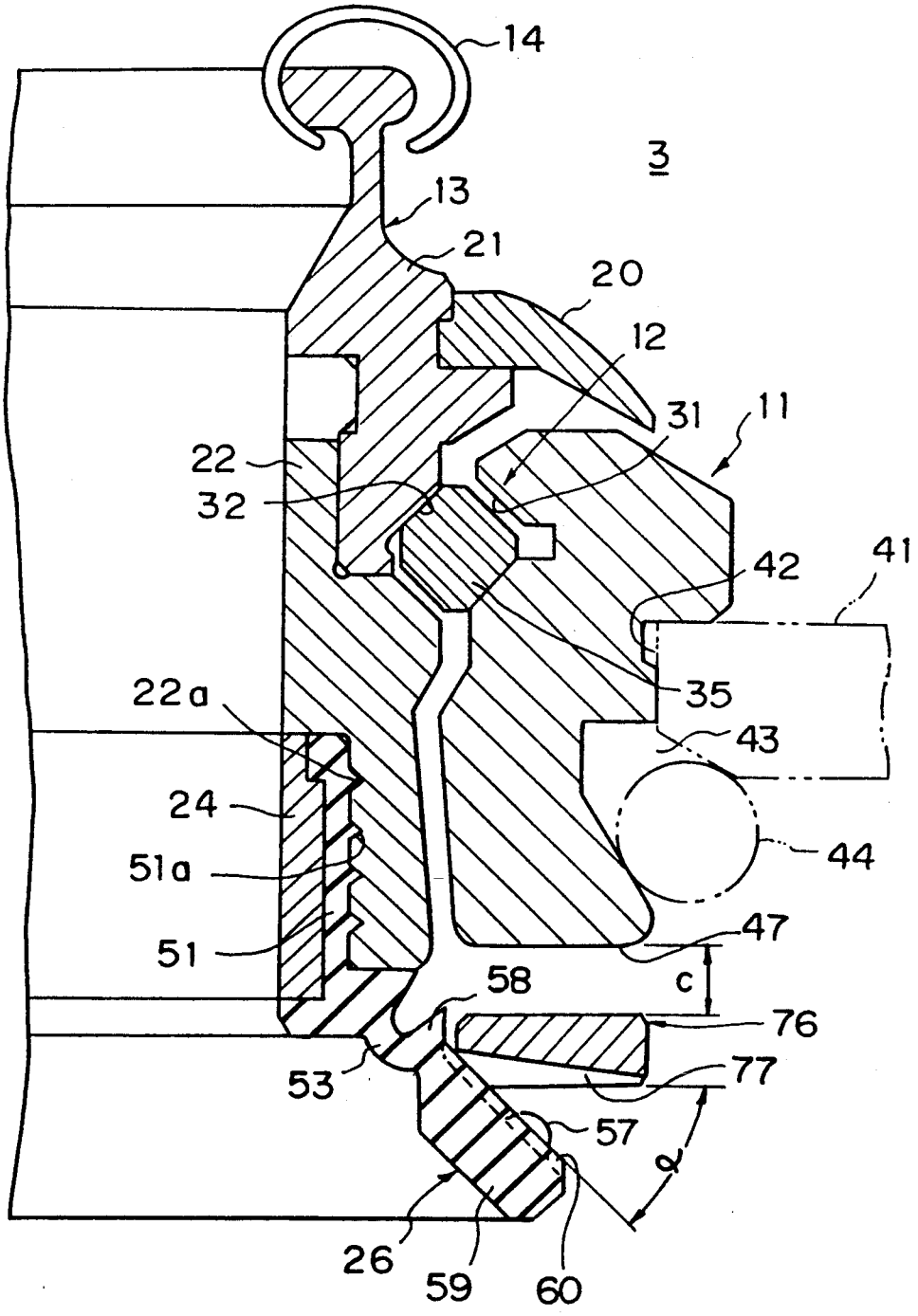
FIG. 3(A) is an axial cross sectional view of a third embodiment of a rotary ring for spinning in accordance with the present invention.
FIG. 3(B) is a front view illustrating a relationship between a braking shoe and a braking runner used in the rotary ring for spinning illustrated in FIG. 3(A), when a ring-shaped rotary member is at a standstill.
FIG. 3(C) is a partial axial cross sectional view illustrating a relationship between the braking shoe and the braking runner in the rotary ring for spinning illustrated in FIG. 3(A), when the ring-shaped rotary member is rotated and the braking runner is in contact with a lower end face of a holder.
Figure 3:
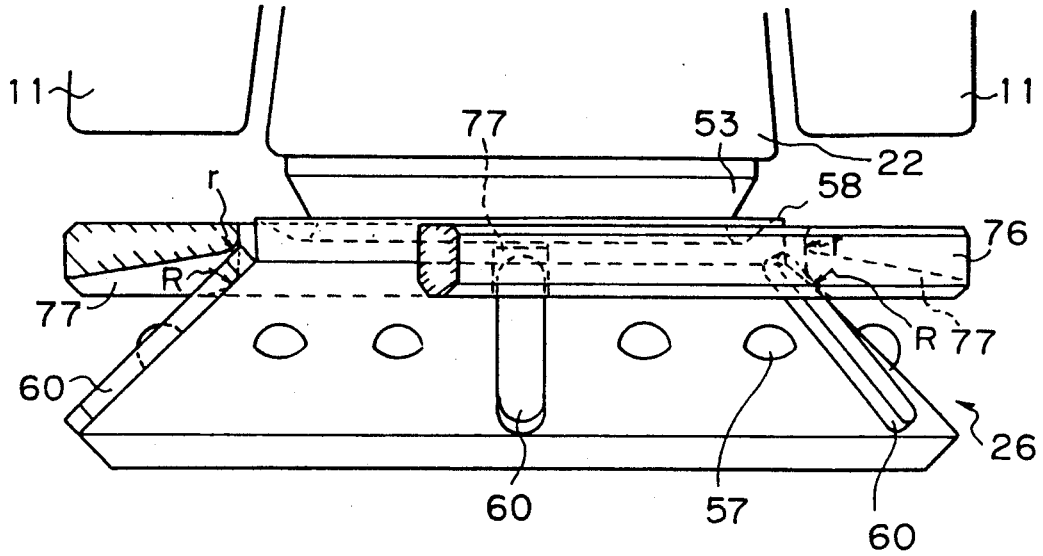
Figure 3:
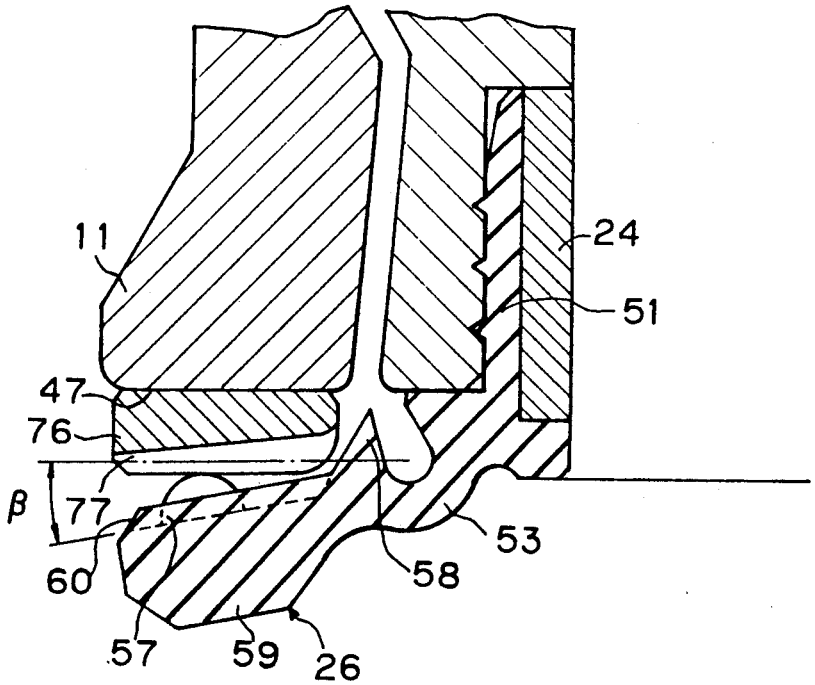

A third embodiment of a rotary ring for spinning in accordance with the present invention is illustrated in FIGS. 3(A), 3(B) and 3(C). An axial cross sectional view thereof is illustrated in FIG. 3(A), a front view of a relationship between a braking shoe and a braking runner in the third embodiment, when a ring-shaped rotary member is at a standstill is illustrated in FIG. 3(B), and a partial axial cross sectional view of a relationship between the braking shoe and a braking runner in the third embodiment, when a ring-shaped rotary member is rotated and the braking runner is in contact with a lower end face of a holder, is illustrated in FIG. 3(C).

As clearly illustrated in FIG. 3(B), four radial grooves 77 are provided on a lower face of the braking runner 76 in the rotary ring 3. The four radial grooves 77 are equally spaced from each other, and a depth of the groove 77 in the braking runner 8 is deepest at the innermost side of the braking runner 76 and is shallowest at the outermost side. Four radial protrusions 60 equally spaced from each other are provided on an upper face of an inclining portion 59 of a braking shoe 26. A position of the groove 77 corresponds to a position of the protrusion 60, and accordingly, when the ring-shaped rotary member 13 is rotated and the inclining portion 59 is raised upward, the protrusion 60 is engaged with the groove 77 as shown in FIG. 3(C), so that the braking runner 76 can be correctly rotated with the ring-shaped rotary member 13 and a generation of friction between the braking shoe 26 and the braking runner 76 can be completely prevented.

Figure 4:
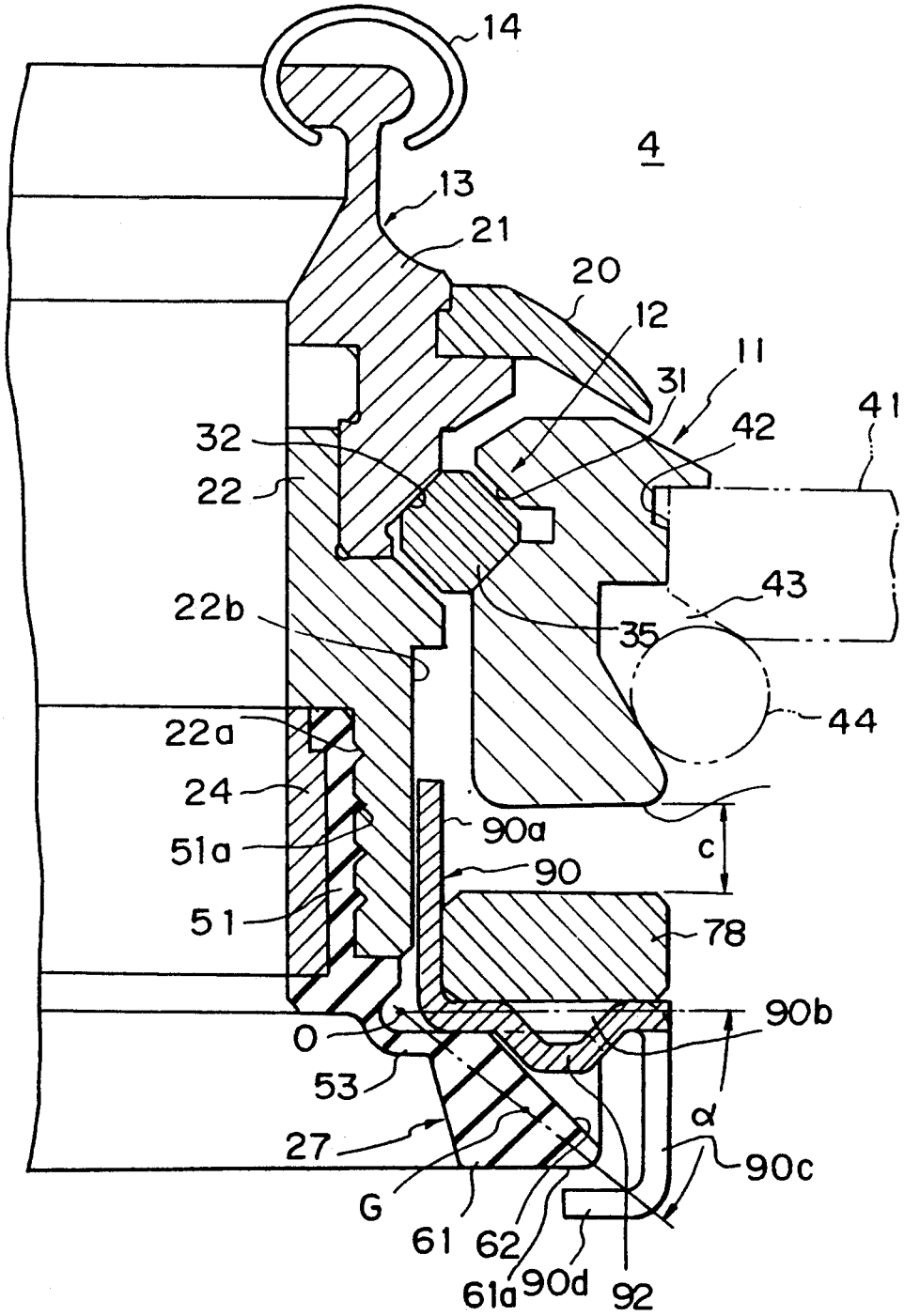
FIG. 4(A) is an axial cross sectional view of a fourth embodiment of a rotary ring for spinning in accordance with the present invention.
FIG. 4(B) is a partial axial cross sectional view illustrating a relationship between a braking shoe and a braking runner in the rotary ring for spinning illustrated in FIG. 4(A), when the ring-shaped rotary member is rotated and the braking runner is in contact with a lower end face of a holder.
Figure 4:
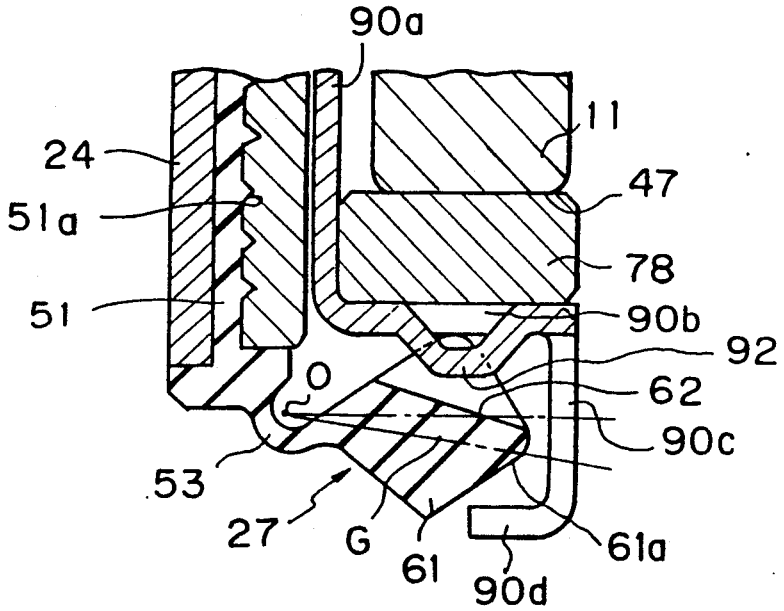

A fourth embodiment of a rotary ring for spinning in accordance with the present invention is illustrated in FIGS. 4(A) and 4(B). An axial cross sectional view thereof is illustrated in FIG. 4(A) and a partial axial cross sectional view of a relationship between a braking shoe and a braking runner in the fourth embodiment, when a ring-shaped rotary member is rotated and the braking runner is in contact with a lower end face of a holder, is illustrated in FIG. 4(B).

A feature of the rotary ring 4 of the fourth embodiment is that a lift guide 90 is further arranged between the braking shoe 27 and the braking runner 78. A braking runner having substantially identical shape to a braking runner 75 in the second embodiment is used as the braking runner 78. The lift guide 90 comprises an inner annular portion **90*a* extending upward along an outer circumferential surface 22*b* of a lower portion of the ring-shaped rotary member 13, a horizontal brim portion 90*b* extending in a horizontal plane from a lower end of the inner annular portion 90*a*, and having a plurality of protrusions 92 protruding downward to the same level and equally spaced from each other on the same circle about a rotational axis of the ring-shaped rotary member 13, and a plurality of hooks having a vertical portion 90***c* extending downward from portions equally from spaced each other on an outer peripheral edge of the horizontal brim portion 90*b* and a horizontal portion 90*d* extending inward from a lower end of the vertical portion, so that the hooks enclose an outer end of an inclining portion 61 of the braking shoe 27 when the inclining portion 61 rises through the lift guide 90 to a braking runner 78.

A braking shoe 27 used in the fourth embodiment differs only in the structure of an inclining portion 61, compared with the inclining portions 56 or 59 used in the embodiments described herebefore. Namely a peripheral brim portion 61 corresponding to an inclining portion in the other embodiments is extended outward and downward from a bending portion 53, and a plurality of radial grooves 62 capable of engaging with the protrusions 92 of the lift guide 90 are provided on an upper face of the peripheral brim portion 61 of the braking shoe 27. Accordingly when the ring-shaped rotary member 13 is rotated and the peripheral brim portion 61 is bent upward by a centrifugal force, the protrusions of the lift guide 90 are inserted to the radial grooves 62 of the peripheral brim portion 61 of the braking shoe 27, a rotation of the braking shoe 27 is surely transmitted to the lift guide 90, and the braking runner 78 is then raised through the lift guide 90. When the rotation speed of the ring-shaped rotary member 13 is reduced, the peripheral brim portion 61 of the braking shoe 27 returns to the original position thereof, and then an under surface 61*a* of the peripheral brim portion 61 comes into contact with the horizontal portion 90*d* of the each hook, so that the lift guide 90 and the braking runner 78 are pushed down by the horizontal portion 90*d*.

In this embodiment, it is possible to increase a moving length of the braking runner 78 by providing the lift guide 90.

Figure 5B:
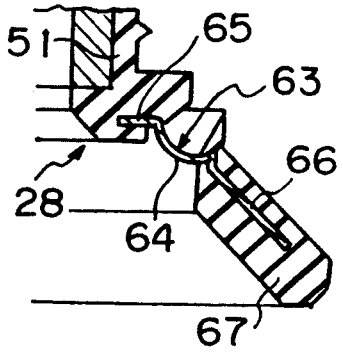
FIG. 5(B) is an axial cross sectional view of an embodiment of a braking shoe used in the rotary ring for spinning illustrated in FIG. 5(A)
Figure 5C:
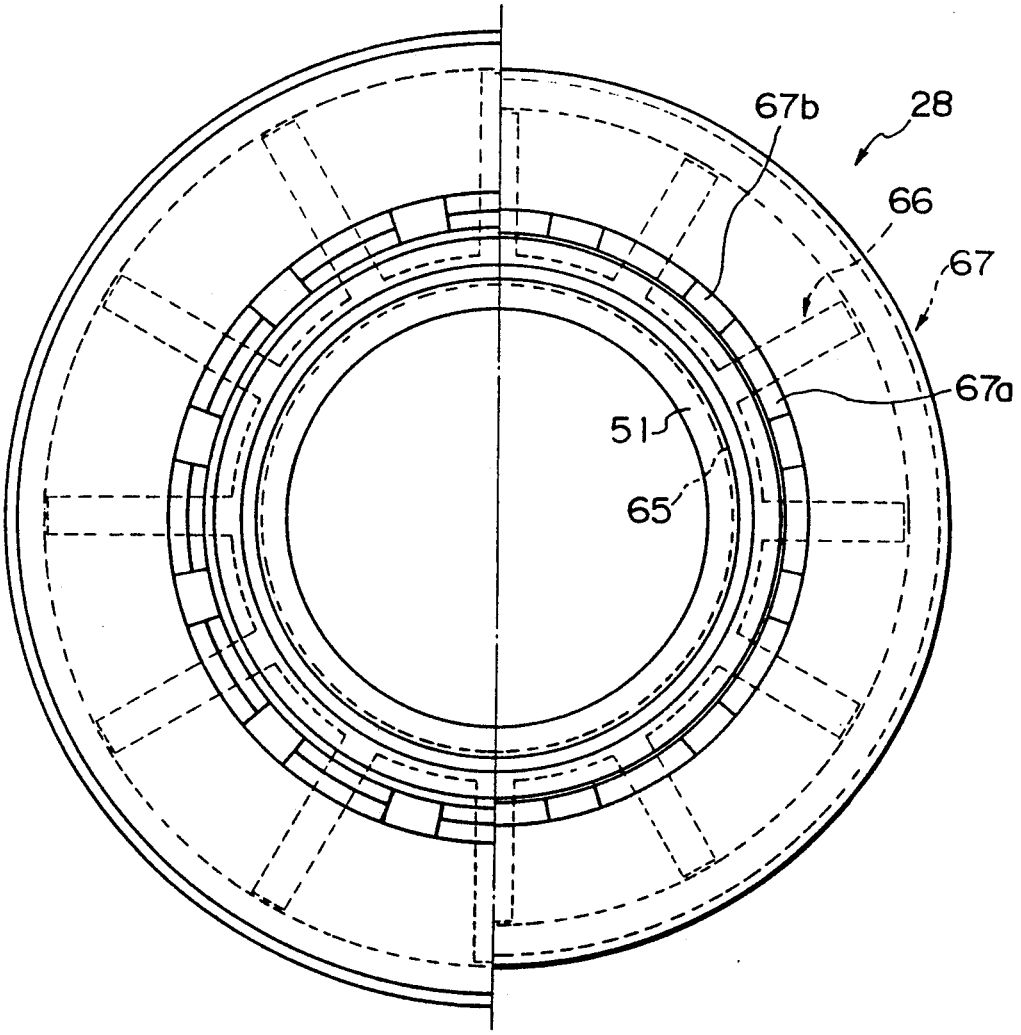
FIG. 5(C) is a plan view of the braking shoe illustrated in FIG. 5(B), in which a right half portion shows the braking shoe when the ring-shaped rotary member is at a standstill, and a left half portion shows the braking shoe when the ring-shaped rotary member is rotated and an inclining portion is bent upward.

A fifth embodiment of a rotary ring for spinning in accordance with the present invention is illustrated in FIGS. 5(A), 5(B) and 5(C). A partial axial cross sectional view thereof is illustrated in FIG. 5(A), an axial cross sectional view of an embodiment of a braking shoe in the fifth embodiment is illustrated in FIG. 5(B), and an enlarged plan view of the braking shoe in the fifth embodiment is illustrated in FIG. 5(C).

A feature of the rotary ring 5 of the fifth embodiment is that a plate spring 63 is used for an bending portion 64 of the braking shoe 28, an upper portion 65 of the plate spring 63 is embedded in a vertical portion 51, and a lower portion 66 is embedded in an inclining portion 67. In FIG. 5(C), the right half portion shows the braking shoe 28 when the ring-shaped rotary member 13 is at a standstill, and the left half portion shows the braking shoe 28 when the ring-shaped rotary member 13 is rotated and an inclining portion 67 is bent upward. In this embodiment, a plurality of protrusions 67*a* are provided on a top end of the inclining portion 67, and a space 67*b* formed between each protrusion 67*a*. This space 67*b* enables an easy raising of the inclining portion 67.

In the fifth embodiment, it is possible to adjust precisely a raising operation of the inclining portion by suitably determining characteristics of the plate spring used.

A sixth embodiment of a rotary ring for spinning in accordance with the present invention is illustrated in FIGS. 6(A) and 6(B). An axial cross sectional view thereof is illustrated in FIG. 6(A) and a front view of the braking shoe in the sixth embodiment is illustrated in FIG. 6(B).

A feature of the rotary ring 6 of the sixth embodiment is that an inclining portion 68 of a braking shoe 29 is formed with a wave-like shape, to enable an easy spread of the inclining portion 68. In FIG. 6(B), the right half portion shows the braking shoe 29 when the ring-shaped rotary member 13 is rotated and an inclining portion is bent upward, and the left half portion 68 shows the ring-shaped rotary member 13 at a standstill.

In the sixth embodiment, it is possible to easily raise the inclining portion by making the shape of the inclining portion to a wave-like shape, because a peripheral edge of the inclining portion can be easily spread by the wave-like shape, even if the same material is used for the inclining portion.

As described herebefore, the rotary ring for spinning in accordance with the present invention can attain superior spinning operation in a broad range of a rotational speed of the spindle, particularly at a high rotational speed of the spindle and further can have a thread having a superior evenness by using the braking runner.

I claim:

1. A rotary ring for spinning comprising a holder having a lower end face, a ring-shaped rotary member supported rotatably by a bearing inside the holder, a braking show carried by a lower end of said rotary member and having an upper portion fixed to other lower end of the rotary member, said braking show having a lower portion for extending radially outwardly from said upper portion in a conical shape, said lower portion having an inner face and an outer face, said braking shoe being of a flexibility and shape such that when said rotary member is rotated, the lower portion of the braking shoe will extend radially outwardly to a greater degree due to centrifugal force so that said lower portion will be moved in a space beneath said lower end face of the holder and generally toward said lower end face, a substantially annularly shaped non-magnetic braking runner positioned to be in contact with the outer face of the lower portion of the braking shoe, said braking runner being mounted so as to be carried by the outer face of the braking shoe to frictionally contact said lower end face of the holder and to exert a braking force thereon.

2. A rotary ring for spinning according to claim 1 wherein said braking shoe includes a bending portion between said upper portion and said lower portion.

3. A rotary ring for spinning as set forth in claim 2 wherein said outer face of the braking shoe is formed in such a manner that an angle between a horizontal plane and said outer face is between 30° and 60° degrees when the ring-shaped rotary member is stationary, said lower portion of the braking shoe further comprising a weight such that the lower portion is raised upward about the bending portion by centrifugal force when the ring-shaped rotary member is rotated, whereby said non-magnetic braking runner is moved into contact with said lower end face of the holder to apply a braking action to the holder when a predetermined range of rotational speed of the ring-shaped rotary member is attained.

4. A rotary ring for spinning as set forth in claim 2 wherein said bending portion of the braking shoe is formed in an outwardly concave shape when viewed in a vertical cross section along the rotational axis of the ring-shaped rotary member.

5. A rotary ring for spinning as set forth in claim 2 wherein said outer face of said lower portion of said braking shoe further comprises first and second protusions and said non-magnetic braking runner has (a) an upper surface with an annular protrusion thereon and (b) a lower surface with at least one protrusion thereon.

6. A rotary ring for spinning according to claim 2 wherein at least three protrusions equally spaced from each other, each having an arc-shaped top portion, are provided on the outer surface of the lower portion of the braking shoe, whereby the non-magnetic braking runner can be held in a substantially horizontal posture by the support provided by the braking shoe when the ring-shaped rotary member is rotated.

7. A rotary ring for spinning according to claim 2 wherein the braking shoe and the non-magnetic braking runner each have an annular shape with an inner diameter, said braking shoe having an annular protrusion having a wall comprising a diameter smaller than the inner diameter of the non-magnetic braking runner, said annular protrusion being provided in an area between said lower portion and said bending portion of the braking shoe, so as to prevent an irregular movement in a radial direction of the non-magnetic braking runner.

8. A rotary ring for spinning according to claim 7 wherein a plurality of protrusions are spaced apart around the outer face of the lower portion of the braking shoe, each protrusion having a protrusion outer face, the distance from the protrusion outer face of each protrusion to a rotational axis of the braking shoe being smaller than the inner diameter of the non-magnetic braking runner, so as to prevent an irregular movement in a radial direction of the non-magnetic braking runner.

9. A rotary ring for spinning according to claim 2 wherein a plurality of radial protrusions, equally spaced from each other, are provided on the outer face of the lower portion of the braking shoe, and a plurality of radial grooves having a shape capable of engaging with said radial protrusions are provided on a lower face of the non-magnetic braking runner, whereby the non-magnetic braking runner can be simultaneously rotated with the braking shoe.

10. A rotary ring for spinning according to claim 2 wherein a plurality of radial grooves, equally spaced from each other, are provided on the outer face of the lower portion of the braking shoe, and a plurality of radial protrusions having a shape capable of engaging with said radial grooves of the lower portion are provided on a lower face of the non-magnetic braking runner, whereby the non-magnetic braking runner can be simultaneously rotated with the braking shoe.

11. A rotary ring for spinning as set forth in claim 2 wherein said upper portion of said braking shoe further comprises a plurality of circumferentially arrayed alternating protrusions and spaces, and said lower portion of said braking shoe further comprises a braking spring, said braking spring extending at least through said bending portion of said braking shoe.

12. A rotary ring for spinning as set forth in claim 2 wherein at least a portion of said braking shoe comprises a resilient material.

13. A rotary ring for spinning as set forth in claim 12 wherein said resilient material comprises an elastomer having shore hardness of between 50 and 80 degrees.

14. A rotary ring for spinning as set forth in claim 13 wherein said elastomer is from the group consisting essentially of synthetic rubbers, urethane rubber and flurorubber.

15. A rotary ring for spinning as set forth in claim 2 wherein said non-magnetic braking runner comprises a material chosen from the group consisting of resins, polyimide resin, polyamide-imide resin, carbon-fiber reinforced polytetrafluoroethylene resin, and phenolic resin.

16. A rotary ring for spinning as set forth in claim 2 wherein said non-magnetic braking runner comprises a ceramic material.

17. A rotary ring for spinning as set forth in claim 1 wherein said lower end face of the holder is formed as a smooth sliding surface, having a shape which is symmetrical, about a rotational axis of the ring shaped rotary member.

18. A rotary ring for spinning according to claim 1 wherein said lower end face of the holder has a radially inner edge with a lower inner corner comprising a truncated cone shape defining an angled inner surface, and said non-magnetic braking runner including an annular protrusion having a triangular cross section, a hypotenuse of which has a smaller angle to a horizontal plane as compared with said angled inner surface of said lower inner corner, said annular protrusion being provided on an upper corner of the non-magnetic braking runner, whereby when the non-magnetic braking runner is raised upward by the braking shoe, the non-magnetic braking runner is guided along the inner surface of said lower inner corner of the holder so as to prevent irregular movement in a radial direction.

19. A rotary ring for spinning according to claim 1 wherein said upper portion of the braking shoe has at least one circumferential protrusion on an outside surface thereof, said circumferential protrusion formed in such a manner that the circumferential protrusion can be engaged with a circular groove on a surface of a lower portion of the ring-shaped rotary member which confronts said at least one protrusion when said braking shoe is mounted on said rotary member.

20. A rotary ring for spinning as set forth in claim 1 wherein said outer face of said lower portion of said braking shoe further comprises a plurality of radial grooves and said non-magnetic braking runner further comprises a lift guide, said lift guide comprising an inner annular portion and a horizontal brim having a plurality of radial protrusions formed therewith and projecting toward said radial grooves, said horizontal brim further comprises at least one hook portion extending downwardly at least past said lower portion of said braking shoe.

21. A rotary ring for spinning as set forth in claim 1 wherein a lift guide is provided between the braking shoe and the non-magnetic braking runner, said lift guide comprising an inner annular portion extending upwardly along an outer circumferential surface of a lower portion or the ring-shaped rotary member, a horizontal brim portion extending in a horizontal plane from a lower end of the inner annular portion and having a plurality of protrusions protruding downwardly to a predetermined position, said protrusions being spaced equally from each about the rotational axis of the ring-shaped rotary member; at least three hook shaped members, each hook shaped member having (i) a vertical portion extending downward from an outer peripheral edge of the horizontal brim portion and (ii) a horizontal portion extending inward from a lower end of the vertical portion such that each hook encloses an outer end the lower portion of the braking shoe when the lower portion is raised through the lift guide to the non-magnetic braking runner; and said braking shoe comprises a plurality of radial grooves on the outer surface of the lower portion which are capable of engaging with the protrusions of the lift guide, whereby when the ring-shaped rotary member is rotated and the lower portion of the braking shoe is moved upward by centrifugal force, the protrusions of the lift guide are engaged by the radial grooves of the braking shoe to apply a rotation to the lift guide and when the rotation speed of the ring-shaped member is decreased, the lower portion of the braking shoe returns to an original position thereof and an under surface of the lower portion of the braking shoe contacts the horizontal portion of said hook shaped member to push down the lift guide and the non-magnetic braking runner.

22. A rotary ring for spinning as set forth in claim 1 wherein said lower portion of said braking shoe is wave-shaped in the circumferential direction and said non-magnetic braking runner further includes a lower annular surface, said lower annular surface comprising a lower annular protrusion.

23. A rotary ring for spinning as set forth in claim 1 wherein said bearing is comprised of (i) a groove arranged on an outer peripheral surface of the ring-shaped rotary member, (ii) a V-shaped groove arranged on an inner peripheral surface of the holder and (iii) an annular sliding ring having a cross section corresponding substantially to an mounted in a space formed by the groove of the ring-shaped rotary member and the groove of the holder in such a manner that the ring-shaped rotary member can be rotated freely through air gaps formed between the annular sliding ring and said grooves.

* * * * *